US009543725B2

(12) United States Patent
Li

(10) Patent No.: US 9,543,725 B2
(45) Date of Patent: Jan. 10, 2017

(54) PLIERS FOR CRIMPING ELECTRICAL TERMINALS

(71) Applicant: Yu-Hsin Li, Changhua County (TW)

(72) Inventor: Yu-Hsin Li, Changhua County (TW)

( * ) Notice: Subject to any disclaimer, the term of this patent is extended or adjusted under 35 U.S.C. 154(b) by 289 days.

(21) Appl. No.: 14/307,510

(22) Filed: Jun. 18, 2014

(65) Prior Publication Data

US 2015/0372435 A1 Dec. 24, 2015

(51) Int. Cl.
*B25B 27/14* (2006.01)
*H01R 43/042* (2006.01)

(52) U.S. Cl.
CPC ..... *H01R 43/042* (2013.01); *B25B 27/146* (2013.01); *Y10T 29/53226* (2015.01)

(58) Field of Classification Search
CPC ..... B25B 7/00; B25B 7/02; B25B 7/06; B25B 7/08; B25B 27/146; H01R 43/042; Y10T 29/53226
See application file for complete search history.

(56) References Cited

U.S. PATENT DOCUMENTS 4,381,661 A 5/1983 Wiener
5,792,165 A * 8/1998 Klieman ..... A61B 17/29 606/170
5,817,119 A * 10/1998 Klieman ..... A61B 17/29 606/170
5,827,323 A * 10/1998 Klieman ..... A61B 17/29 606/170
2012/0080501 A1* 4/2012 Morgan ..... A61B 17/00234 227/180.1

* cited by examiner

*Primary Examiner* — Carl Arbes
(74) *Attorney, Agent, or Firm* — Guice Patents PLLC

(57) ABSTRACT

Pliers include a pair of arm members, a pair of handles, at least one interchangeable working jaw and a control mechanism. Each arm member includes two parallel arm plates. The handles are connected to each other for movement of the arm members towards and away from each other. The working jaw is detachably supported in between the arm plates of the associated arm member. The control mechanism includes a retaining spacer, a driving member and a spring biased between the retaining spacer and the driving member. The retaining spacer is positioned in between the arm plates of the arm member. The driving member is movably disposed in between the arm plates of the arm member and has an end knob exposed outside the arm member so that pressing of the end knob of the driving member drives the driving member to be engaged with or disengaged from the working jaw.

13 Claims, 19 Drawing Sheets

PLIERS FOR CRIMPING ELECTRICAL TERMINALS

BACKGROUND OF THE INVENTION

1. Field of the Invention

The present invention relates to pliers and more particularly to pliers for crimping electrical terminals with interchangeable working jaws.

2. Description of the Related Art

As disclosed in U.S. Pat. No. 4,381,661, conventional crimping pliers often provide a pair of working jaws attached to two arm members of the crimping pliers by screws. Thus, the working jaws with different sizes or shapes may be removed by loosening the screws and replaced by new ones and finally re-tightening the screws back again. As can be imagined, it is a really tiresome piece of work simply to interchange the pair of working jaws with another pair.

SUMMARY OF THE INVENTION

Accordingly, it is an object of the present invention to provide improved pliers with interchangeable working jaws which can be easily and quickly attached and detached from the rest of the pliers.

Specifically, the pliers include a pair of arm members, a pair of handles, at least one interchangeable working jaw and at least one control mechanism. Each of the arm members includes two spaced apart, generally planar, parallel arm plates. The handles are connected to each other for movement of the arm members towards and away from each other. The working jaw is detachably supported in between the arm plates of the associated arm member. The control mechanism includes a retaining spacer, a driving member and a spring biased between the retaining spacer and the driving member. The spacer is positioned in between the arm plates of the arm member. The driving member is movably disposed in between the arm plates of the arm member and has an end knob exposed outside the arm member. In particular, the control mechanism is arranged in a manner that pressing of the end knob of the driving member drives the driving member to displace with respect to the arm member in a direction substantially vertical to the arm member between a locking position and a releasing position. In the locking position, the driving member is engaged with the working jaw for stopping the working jaw from departing from the arm member. In the releasing position, the driving member is disengaged with the working jaw to allow detachment of the working jaw from the arm member.

Preferably, the driving member includes a rod body having the end knob, and an engaging portion extending from a side of the rod body for engagement with the working jaw. And, the spring is mounted around the rod body and biased between the retaining spacer and a shoulder of the rod body.

Further benefits and advantages of the present invention will become apparent after a careful reading of the detailed description with appropriate reference to the accompanying drawings.

DETAILED DESCRIPTION OF EMBODIMENTS

Figure 1:
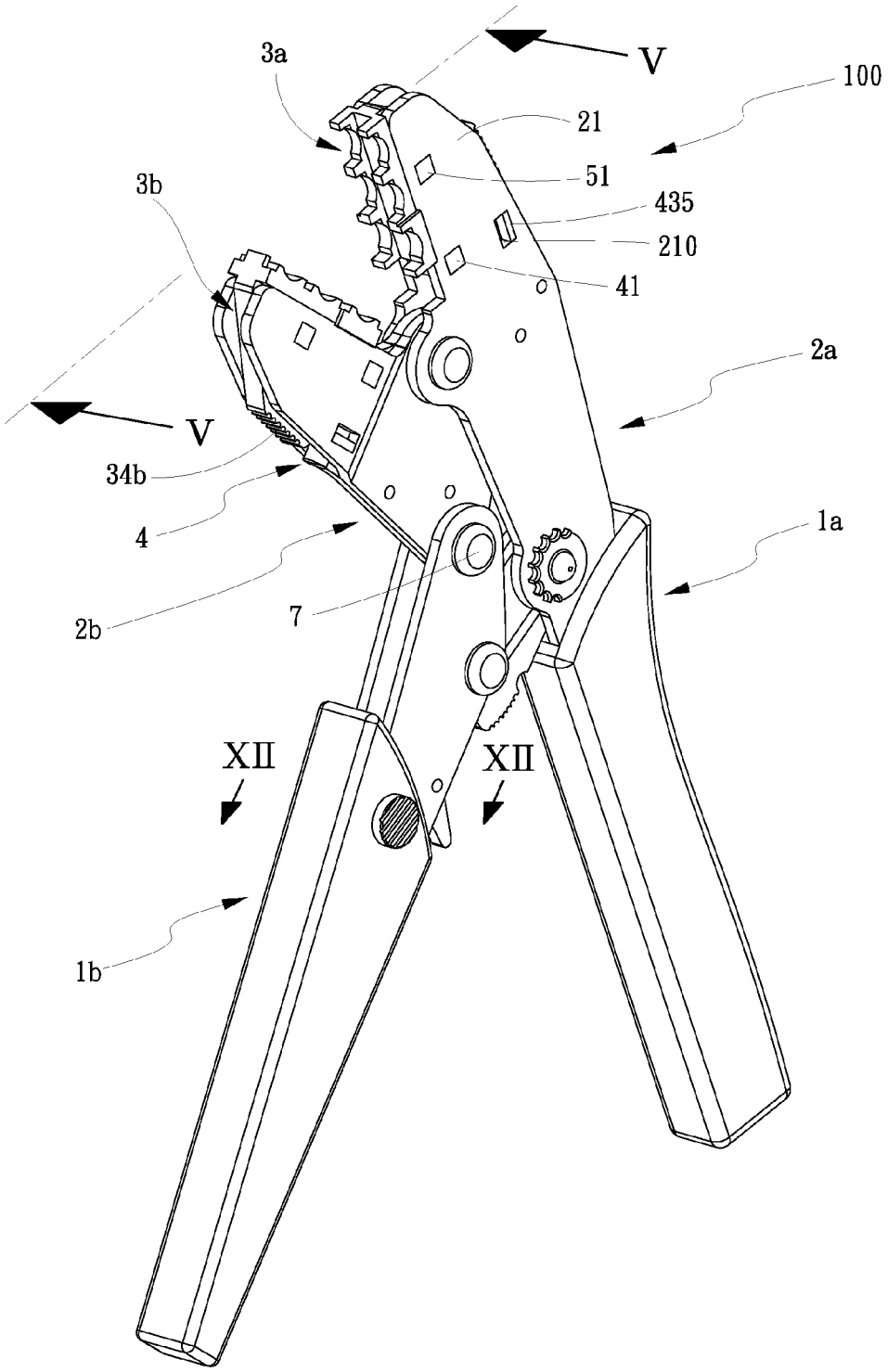
FIG. 1 is a side perspective view of pliers in accordance with a first embodiment of the present invention.
Figure 2:
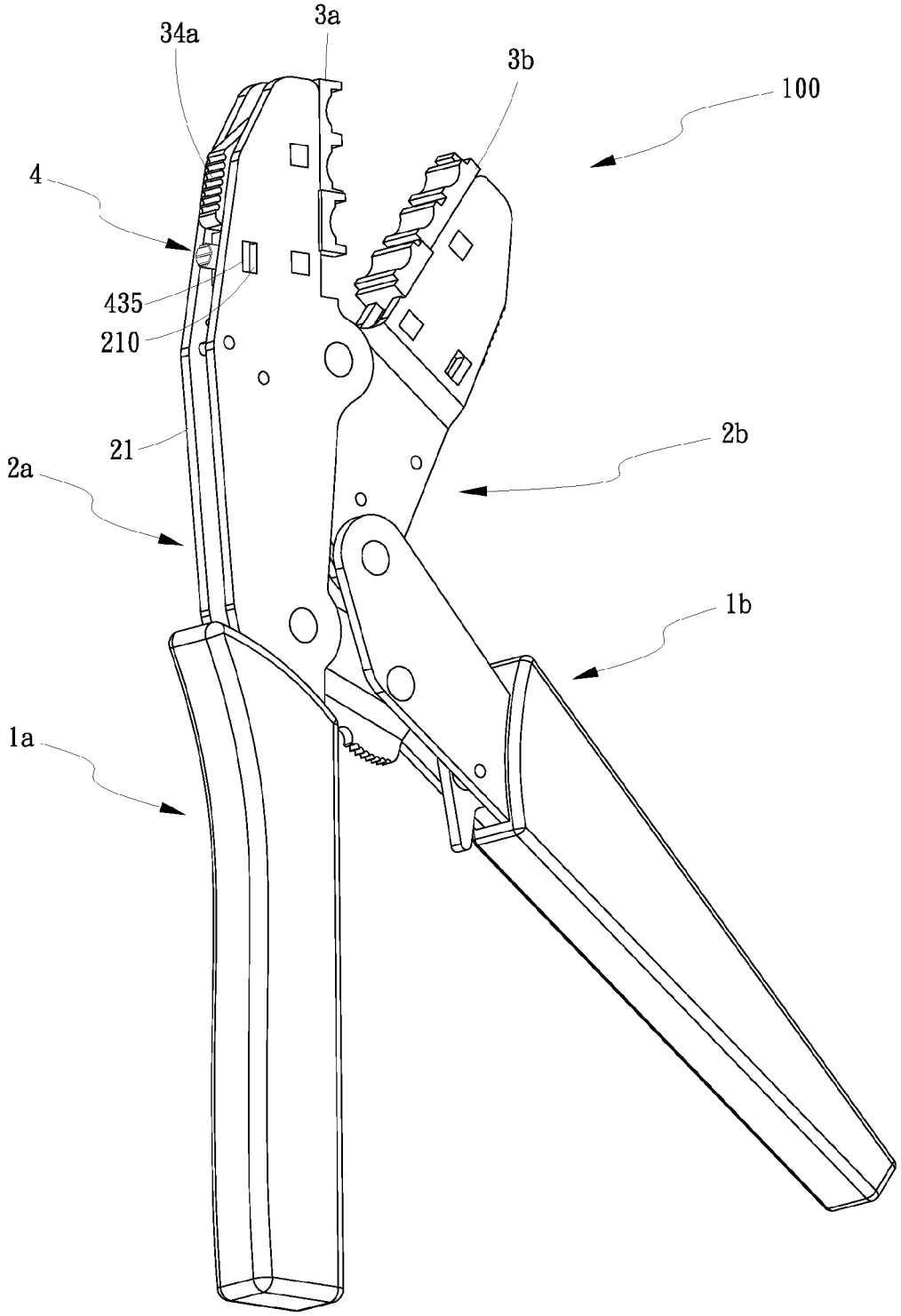
FIG. 2 is an opposite side perspective view of pliers shown in FIG. 1.
Figure 19:
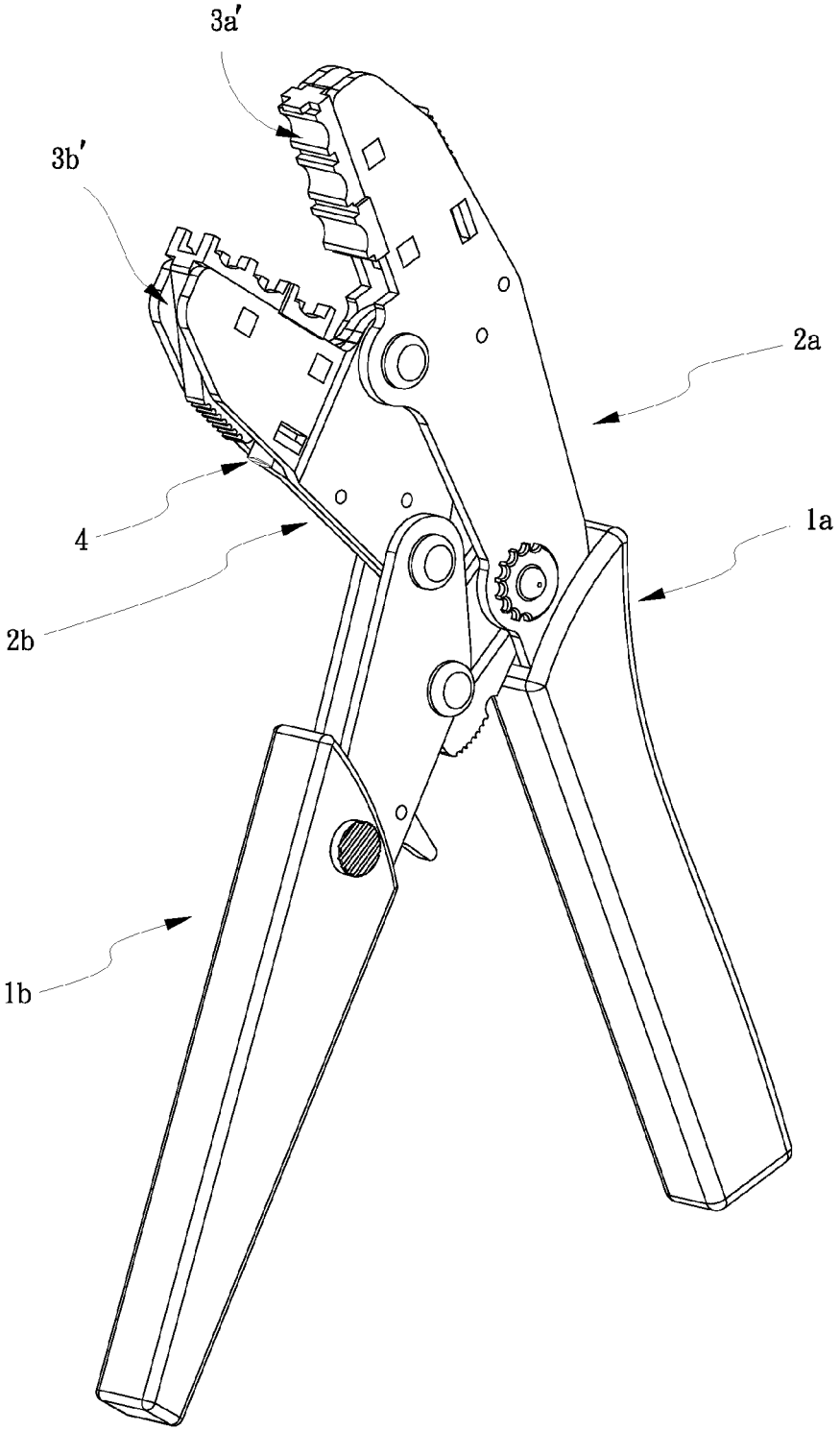
FIG. 19 is a view similar to FIG. 1, except that another pair of working jaws replaces the pair of the working jaws in FIG. 1.

With reference to FIGS. 1-13, there are shown pliers 100 for crimping terminals on wires or connectors according to a first embodiment of the invention. As shown, the pliers 100 include a pair of handles 1*a*, 1*b*, a pair of arm members 2*a*, 2*b* and a pair of working jaws 3*a*, 3*b*. The right-hand arm member 2*a* is rigidly connected to or integrated with the right handle 1*a*. The left-hand arm member 2*b* is pivotally connected to the left-hand handle 1*b* by means of a pivot pin 7. The handles 1*a*, 1*b* are pivotally connected for movement of the arm members 2*a*, 2*b* towards and away from each other. The working jaws 3*a*, 3*b* can be interchanged with other pairs of jaws 3*a*', 3*b*' (see FIG. 19) and they are fixed to their associated arm members 2*a*, 2*b* in a manner which will be described later in further detail. As shown in FIGS. 1 and 2, it is preferred that each of the working jaws 3*a*, 3*b* have a textured side surface 34*a* or 34*b* to facilitate gripping of the working jaw 3*a* or 3*b* for further interchange of the working jaws 3*a* or 3*b* with others.

Figure 3:
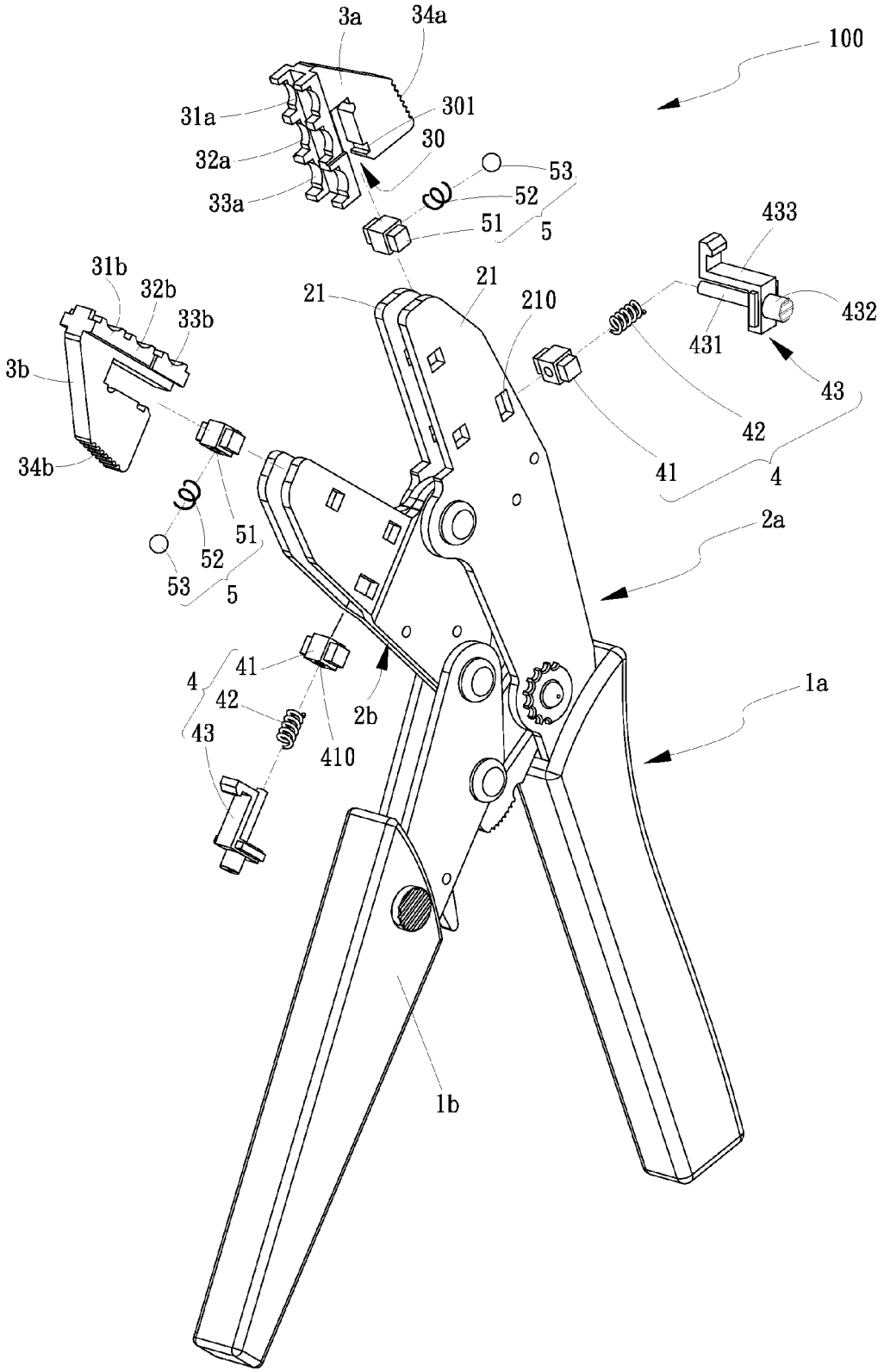
FIG. 3 is an exploded perspective view of the pliers shown in FIG. 1.

Referring to FIG. 3, each of the arm members 2*a*, 2*b* includes two spaced apart, generally planar, parallel arm plates 21. The working jaws 3*a*, 3*b* are detachably supported in between the arm plates 21 of the respective arm members 2*a*, 2*b* and provided with three mating pairs of crimping dies 31*a*, 31*b*; 32*a*, 32*b*; 33*a*, 33*b*. It is preferred that the pliers 100 be of steel construction for the most part.

Figure 4:
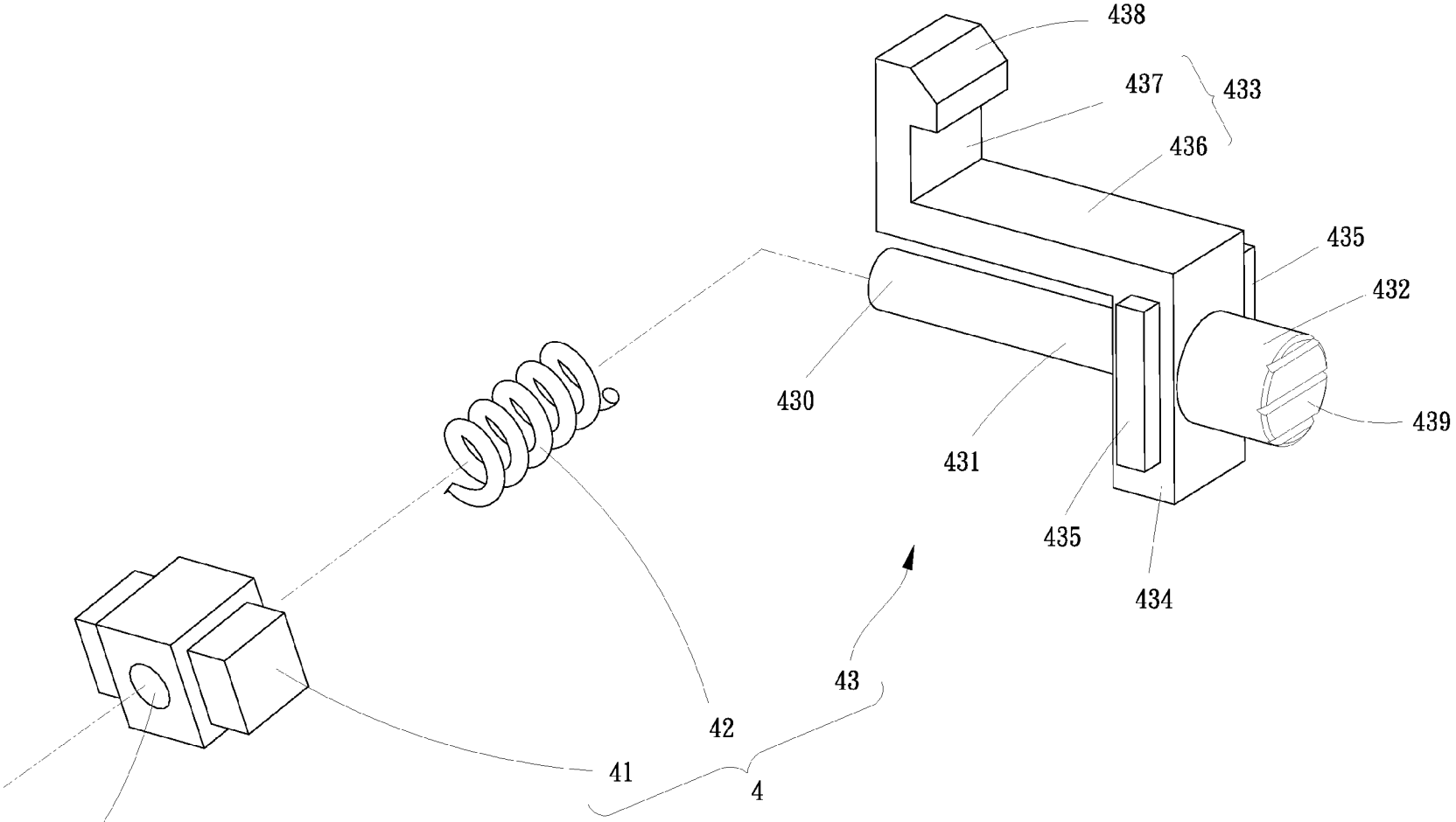
FIG. 4 is a partial enlarged view of the pliers shown in FIG. 3.
Figure 5:
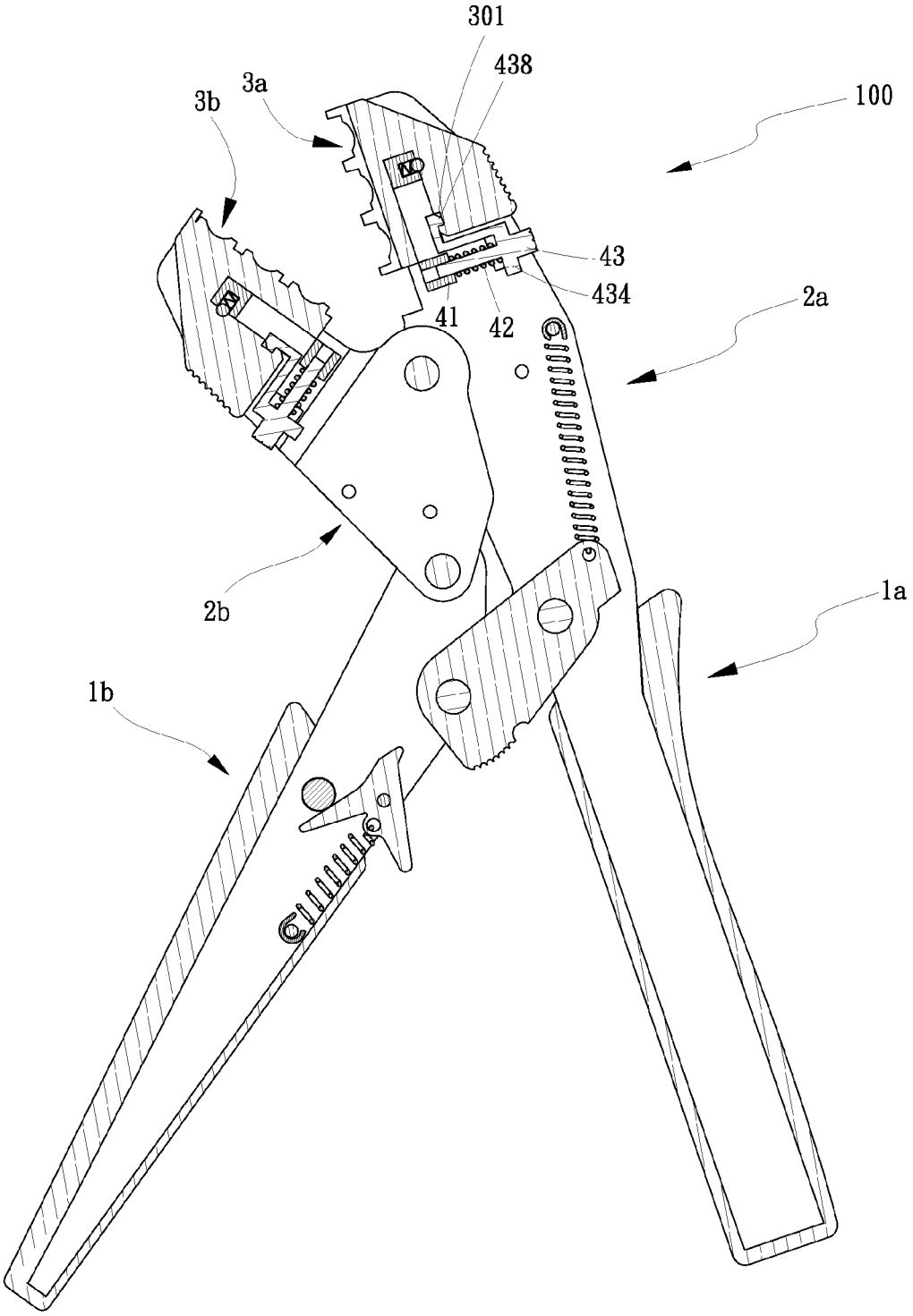
FIG. 5 is a cross-sectional view of the pliers taken along the line V-V in FIG. 1.
Figure 6:
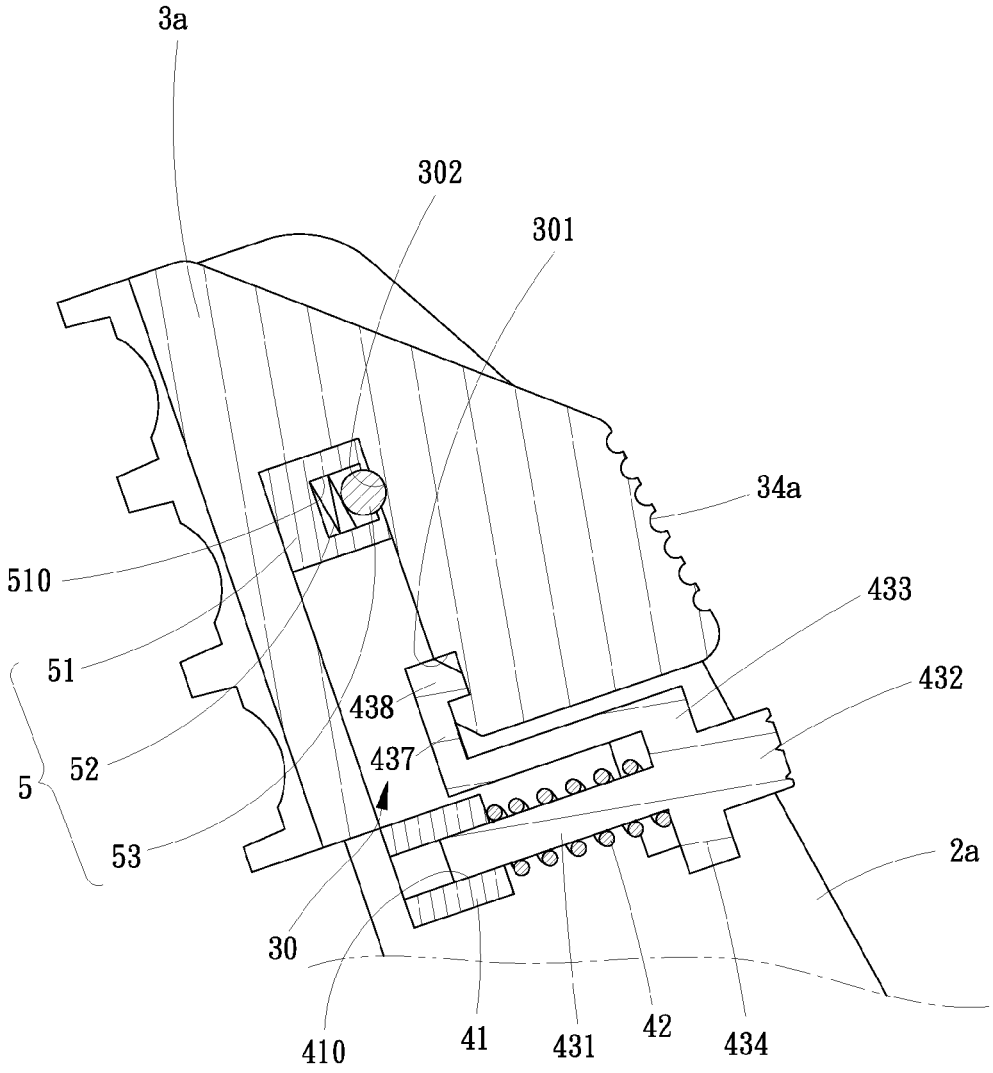
FIG. 6 is a partial enlarged view of the pliers shown in FIG. 5.

The pliers 100 further include a pair of control mechanisms 4 to allow or forbid interchange of the working jaws 3*a*, 3*b* with other working jaws. Each of the control mechanisms 4 includes a retaining spacer 41, a spring 42 and a driving member 43. The retaining spacer 41 is positioned in between the arm plates 21 of the arm member 2*a* or 2*b* and defines a lateral hole 410 (see FIG. 6). As best seen in FIG. 4, the driving member 43 includes a rod body 431 and an engaging portion 433 extending from a side of the rod body 431. The rod body 431 has an outer end knob 432 exposed outside the arm member 2*a* or 2*b* and an inner end 430 inserted in the lateral hole 410 of the retaining spacer 41 to allow transverse movement of the rod body 431 within the retaining spacer 41. As shown in FIG. 6, the spring 42 is mounted around the rod body 431 of the driving member 43 and is biased between the retaining spacer 41 and a shoulder 434 of the rod body 431. Referring back to FIG. 4, the driving member 43 further includes a pair of projecting lugs 435 extending therefrom and being slidably engaged in the guiding holes 210 respectively defined in the arm plates 21, as shown in FIG. 1 or FIG. 2. In this way, the driving member 43 is movably disposed in between the arm plates 21 of the arm member 2*a* or 2*b*.

In particular, each of the control mechanisms 4 is arranged in a manner that pressing of the end knob 432 of the rod body 431 of the driving member 43 drives the driving member 43 to displace with respect to the arm member 2*a* or 2*b* in a direction substantially vertical to the arm member 2*a* or 2*b* between a locking position (see FIG. 5 or 6) where the driving member 43 is engaged with the associated working jaw 3*a* or 3*b* for stopping the working jaw 3*a* or 3*b* from departing from the arm member 2*a* or 2*b*, and a releasing position (see FIG. 8) where the driving member 43 is disengaged with the working jaw 3*a* or 3*b* to allow detachment of the working jaw 3*a* or 3*b* from the arm member 2*a* or 2*b*. It is preferred that the end knob 432 of the driving member 43 has an outer end surface 439 that is textured to facilitate the pressing of the end knob 432.

As shown in FIG. 4, the engaging portion 433 of the driving member 43 is generally L-shaped, with a substantially transverse first section 436 and a second section 437 that extends substantially perpendicular to the first section 436 and has an end hook 438. On the other hand, as shown in FIG. 6, the working jaws 3*a* defines a notch 30 extending in a direction substantially parallel with the arm member 2*a* to accommodate the second section 437 of the engaging portion 433 of the driving member 43. The notch 30 of the working jaw 3*a* has an inner wall with a locking groove 301 in which the end hook 438 of the second section 437 of the engaging portion 433 is detachably engaged.

Referring back to FIG. 3, the pliers 100 further comprise two guiding mechanisms 5 each including a guiding spacer 51 and a spring-loaded ball detent arrangement having a spring 52 and a ball detent 53. The guiding spacer 51 is arranged a distance from the retaining spacer 41 of the control mechanism 4 and closer to a front end of the arm member 2*a* or 2*b*. Moreover, the guiding spacer 51 and the retaining spacer 41 are arranged in a line corresponding to the notch 30 of the working jaw 3*a* or 3*b* to facilitate initial alignment of the working jaw 3*a* or 3*b* with the arm member 2*a* or 2*b*.

The spring-loaded ball detent arrangement of the guiding mechanism 5 is disposed at a lateral side of the guiding spacer 51 to temporarily hold the working jaw 3*a* or 3*b* in place when the working jaw 3*a* or 3*b* is fitted in between the arm plates 21 of the arm member 2*a*, 2*b*, as shown in FIG. 6. Specifically, the spring 52 is disposed in a recess 510 defined in a side of the guiding spacer 51 and is biased between a bottom of the recess 510 of the guiding spacer 51 and the ball detent 53. And, the ball detent 53 is positioned in a positioning hole 302 defined in the inner wall of the notch 30 of the working jaw 3*a* or 3*b*.

Figure 7:
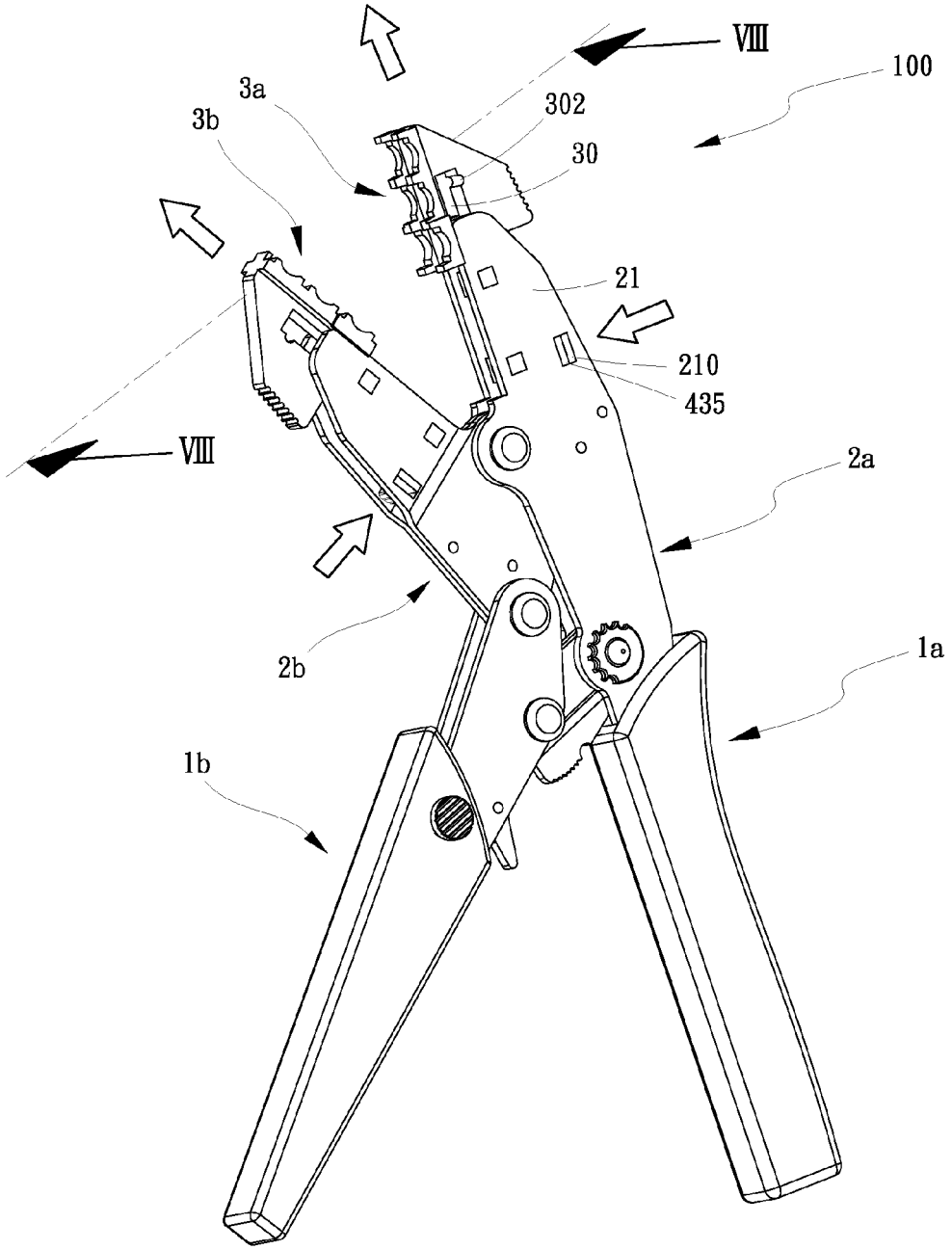
FIG. 7 is another side perspective view of pliers of FIG. 1, showing the working jaws are being withdrawn.
Figure 8:
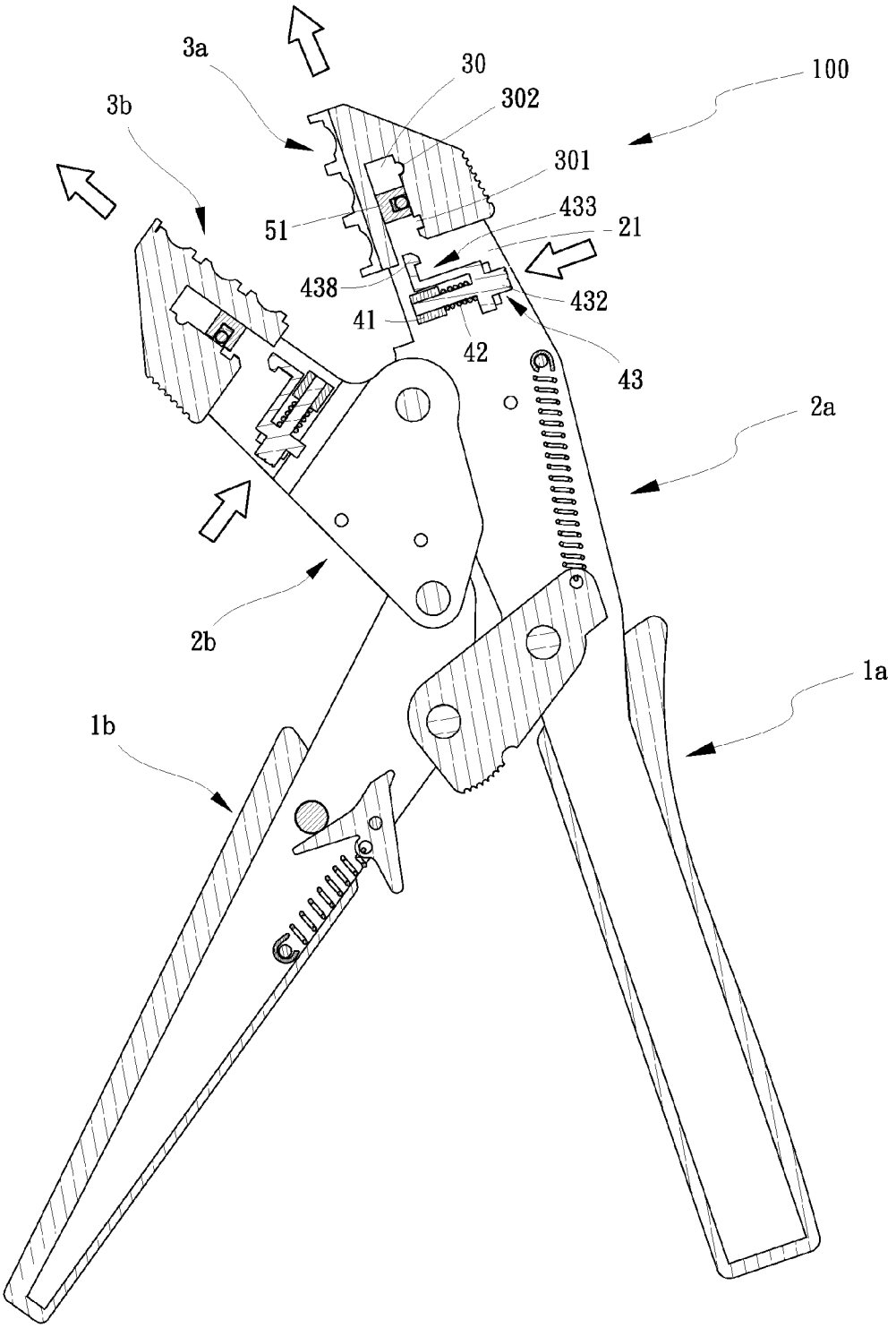
FIG. 8 is a cross-sectional view of the pliers taken along the line VIII-VIII in FIG. 7.

As shown in FIG. 8 and referring to FIG. 7, to remove the working jaw 3*a* or 3*b* from the arm member 2*a* or 2*b*, a user may firstly push the end knob 432 of the driving member 4 with one hand to release the end hook 438 from the locking groove 301 of the working jaw 3*a* or 3*b*, and then draw the working jaw 3*a* or 3*b* out of the arm plates 21 of the arm members 2*a* or 2*b* with the other hand.

Figure 9:
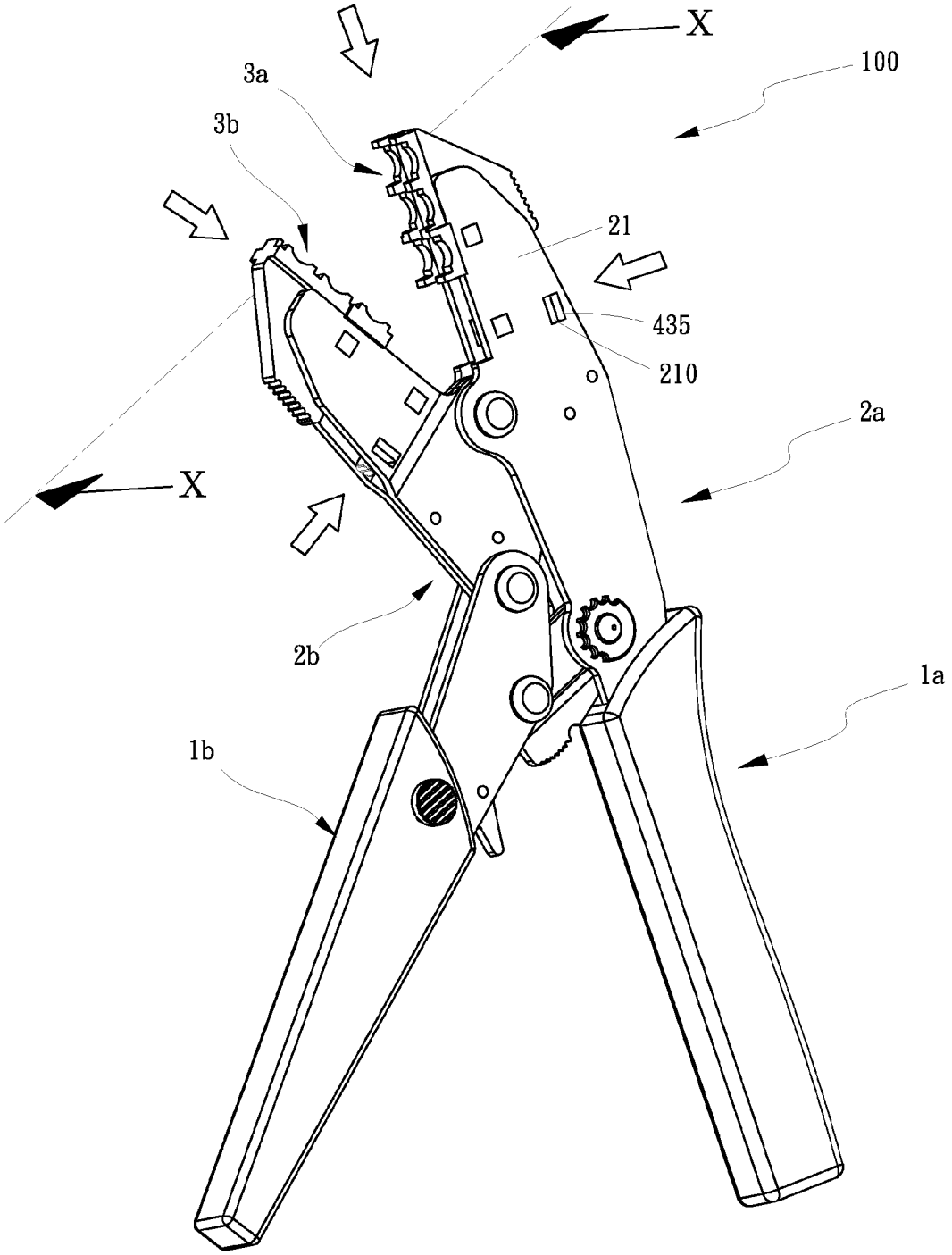
FIG. 9 is yet another side perspective view of pliers of FIG. 1, showing the working jaws are being installed.
Figure 10:
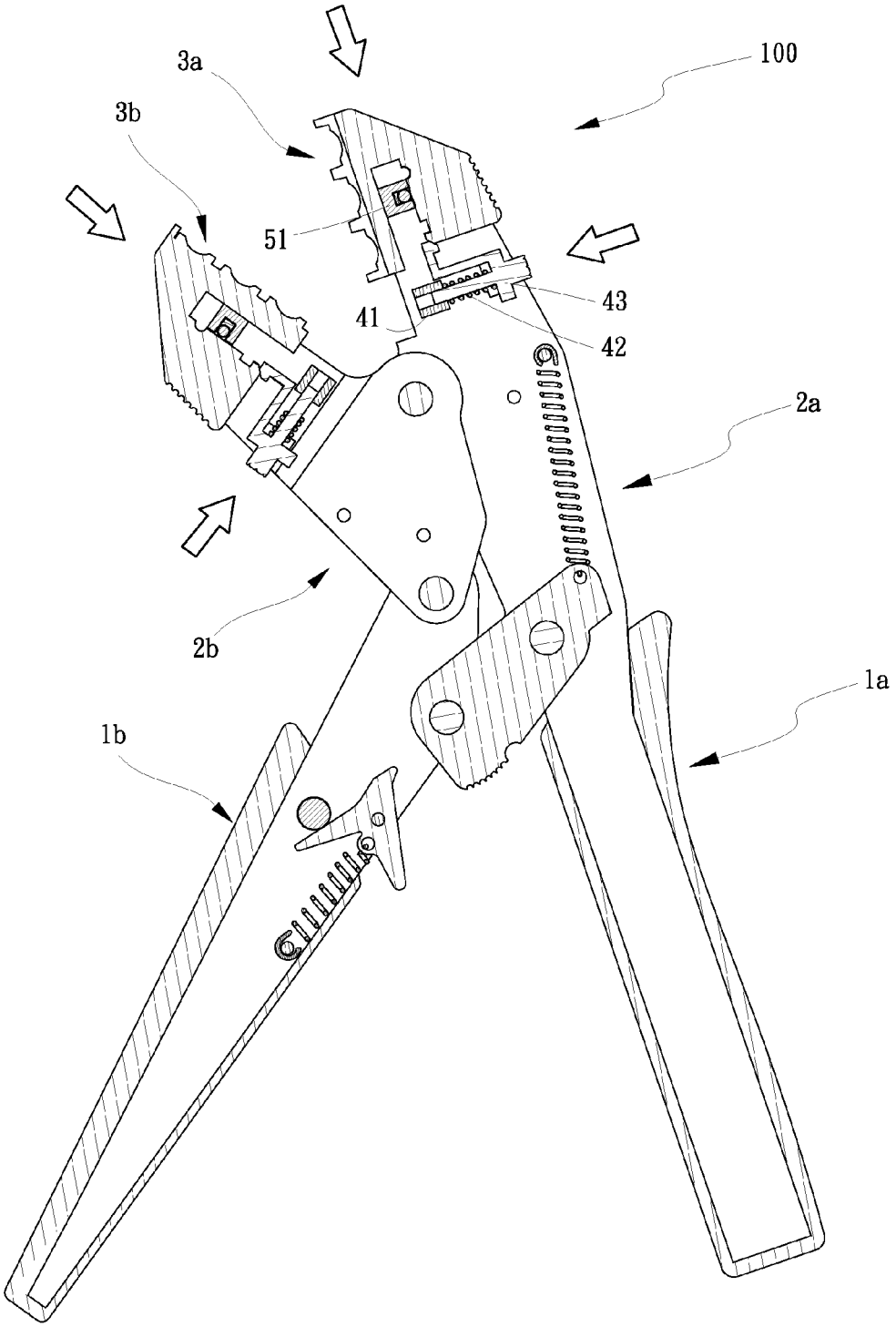
FIG. 10 is a cross-sectional view of the pliers taken along the line X-X in FIG. 9.
Figure 11:
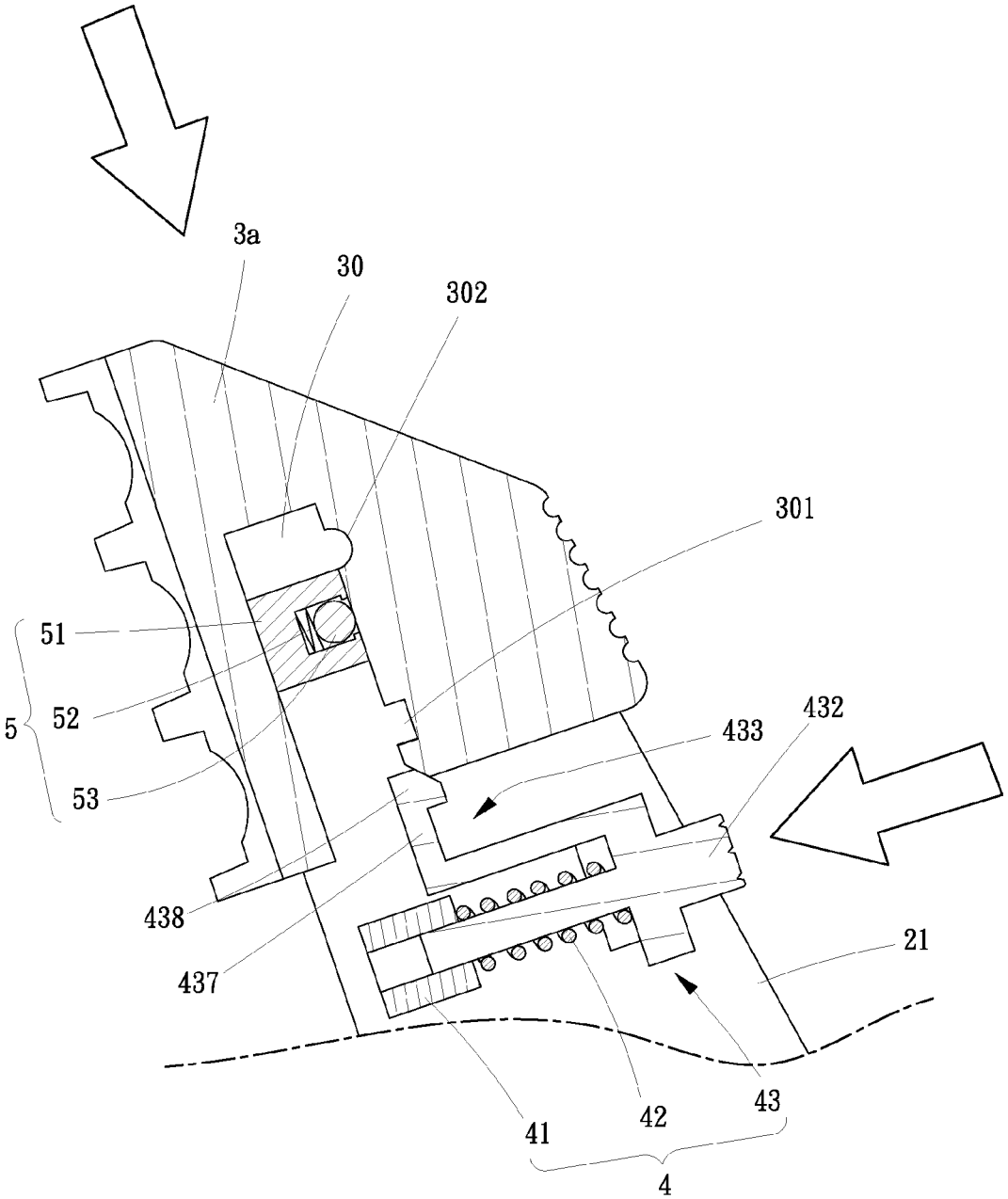
FIG. 11 is a partial enlarged view of the pliers shown in FIG. 10.
Figure 12:
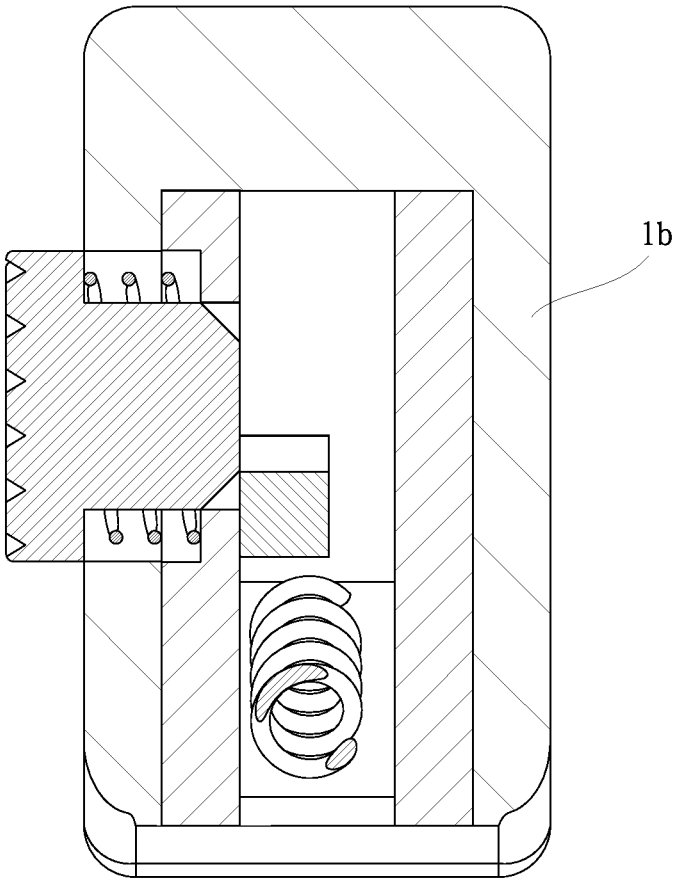
FIG. 12 is a cross-sectional view of the pliers taken along the line XII-XII in FIG. 1.
Figure 13:
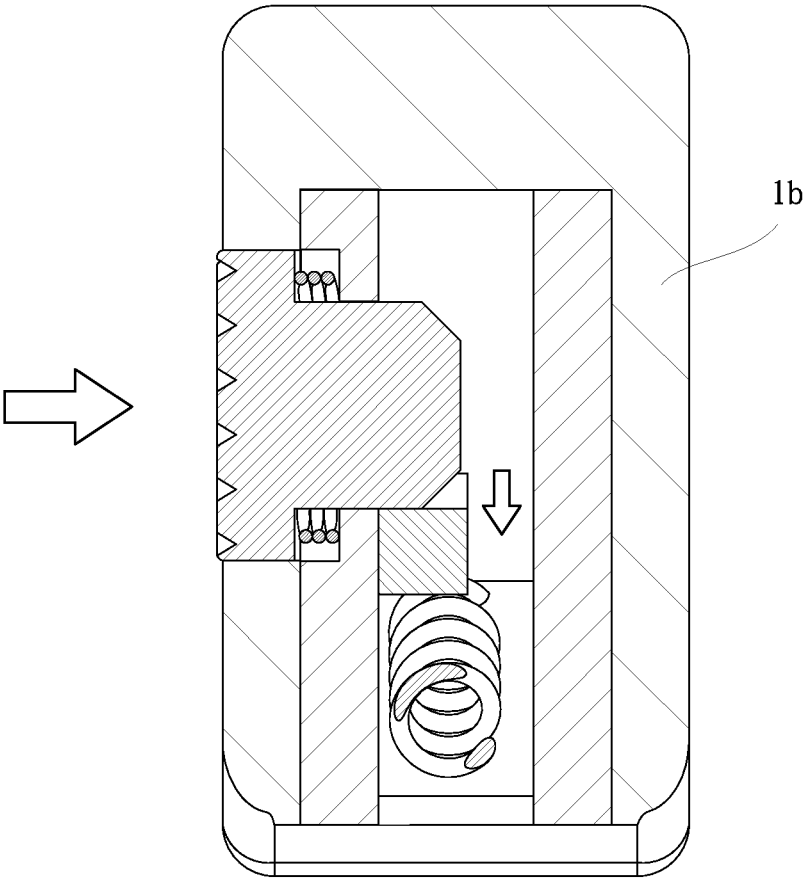
FIG. 13 is a view similar to FIG. 12, showing a button on the left is pushed.
Figure 14:
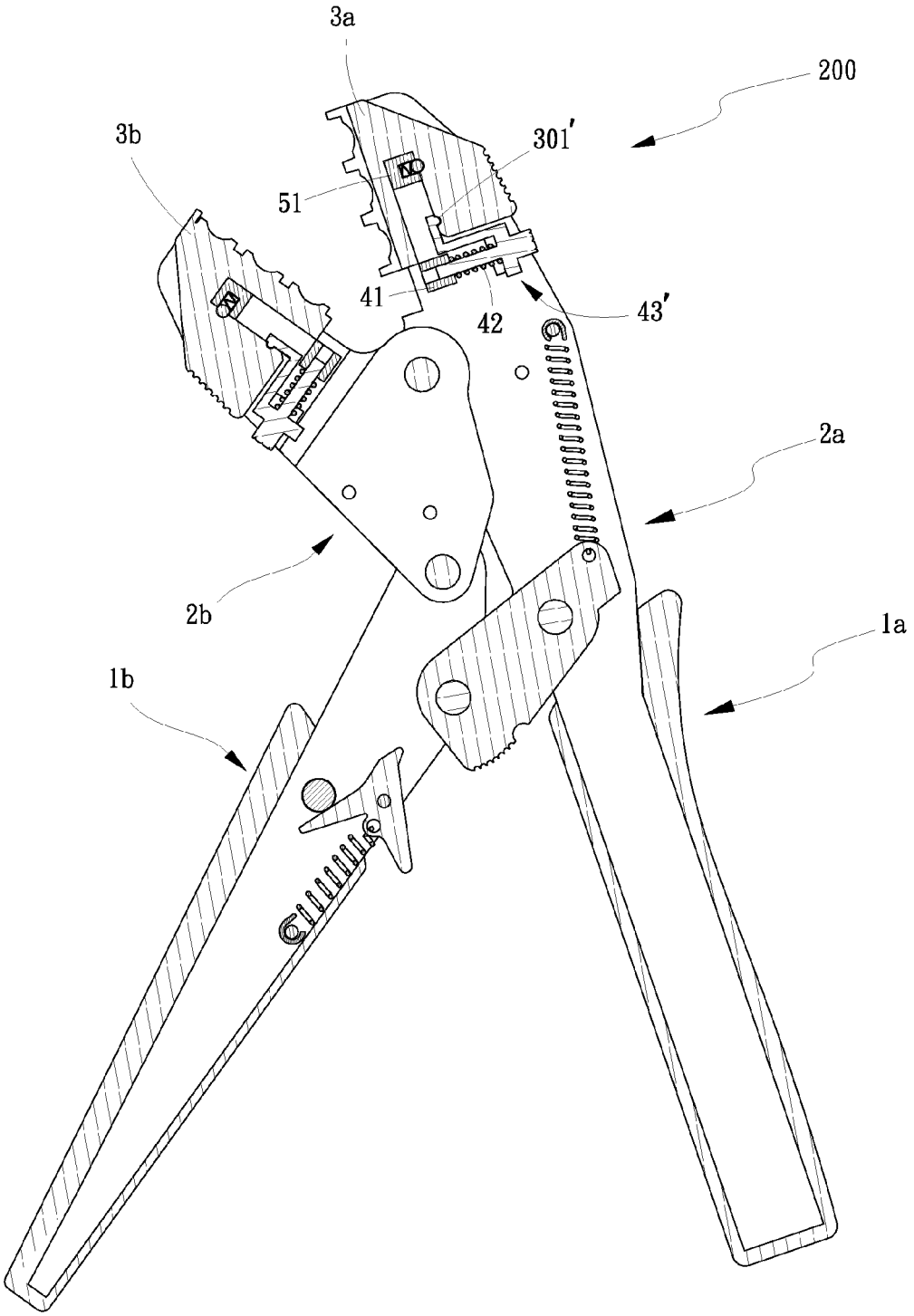
FIG. 14 is a cross-sectional view of pliers in accordance with a second embodiment of the present invention.
Figure 15:
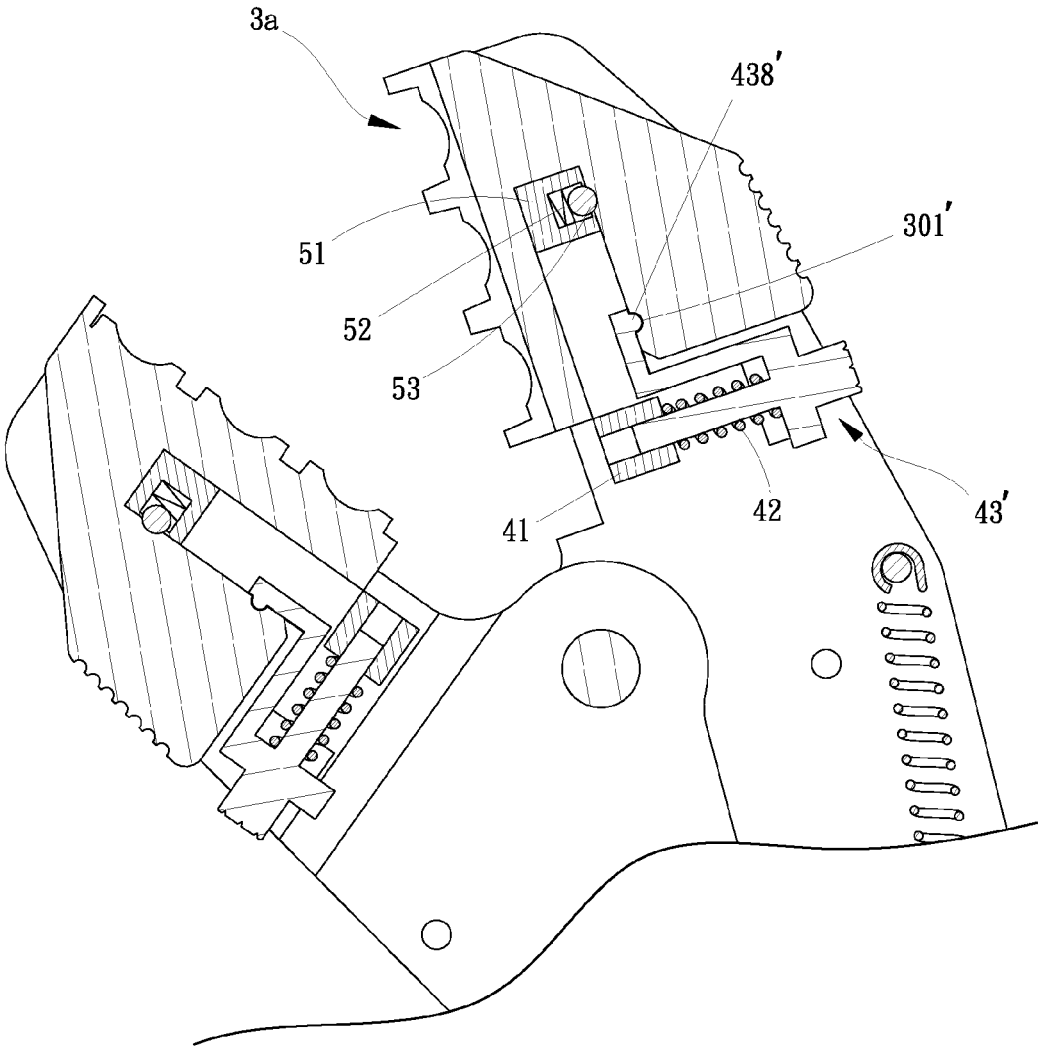
FIG. 15 is a partial enlarged view of the pliers shown in FIG. 14.

On the contrary, as shown in FIGS. 9 and 10, to install the working jaw 3*a* or 3*b* in the arm member 2*a* or 2*b*, the user merely needs to feed the working jaw 3*a* or 3*b* into the gap between the arm plates 21 of the arm members 2*a* or 2*b* along the line defined by the two spacers 41 and 51. That is, in this embodiment, the end hook 438 of the second section 437 of the driving member 43 has a beveled edge which bears against a corner of the working jaw 3*a* or 3*b* while the working jaw 3*a* or 3*b* is moving in between the arm plates 21 of the associated arm member 2*a* or 2*b*. In this way, the longitudinal movement of the working jaw 3*a* or 3*b* will automatically cause the driving member 4 to move transversely and inwardly. Once the beveled edge of the end hook 438 is detached from the corner of the working jaw 3*a* or 3*b*, the driving member 43 will be immediately bounced back, as a result of the spring 42, to have its end hook 438 re-engaged in the locking groove 301, as shown in FIG. 6. Alternatively, in the modification 200 shown in FIGS. 14 and 15, the end hook 438*a* of the driving member 43' may have a rounded side edge fitted in a locking groove 301' with an arc-shaped cross section.

Figure 16:
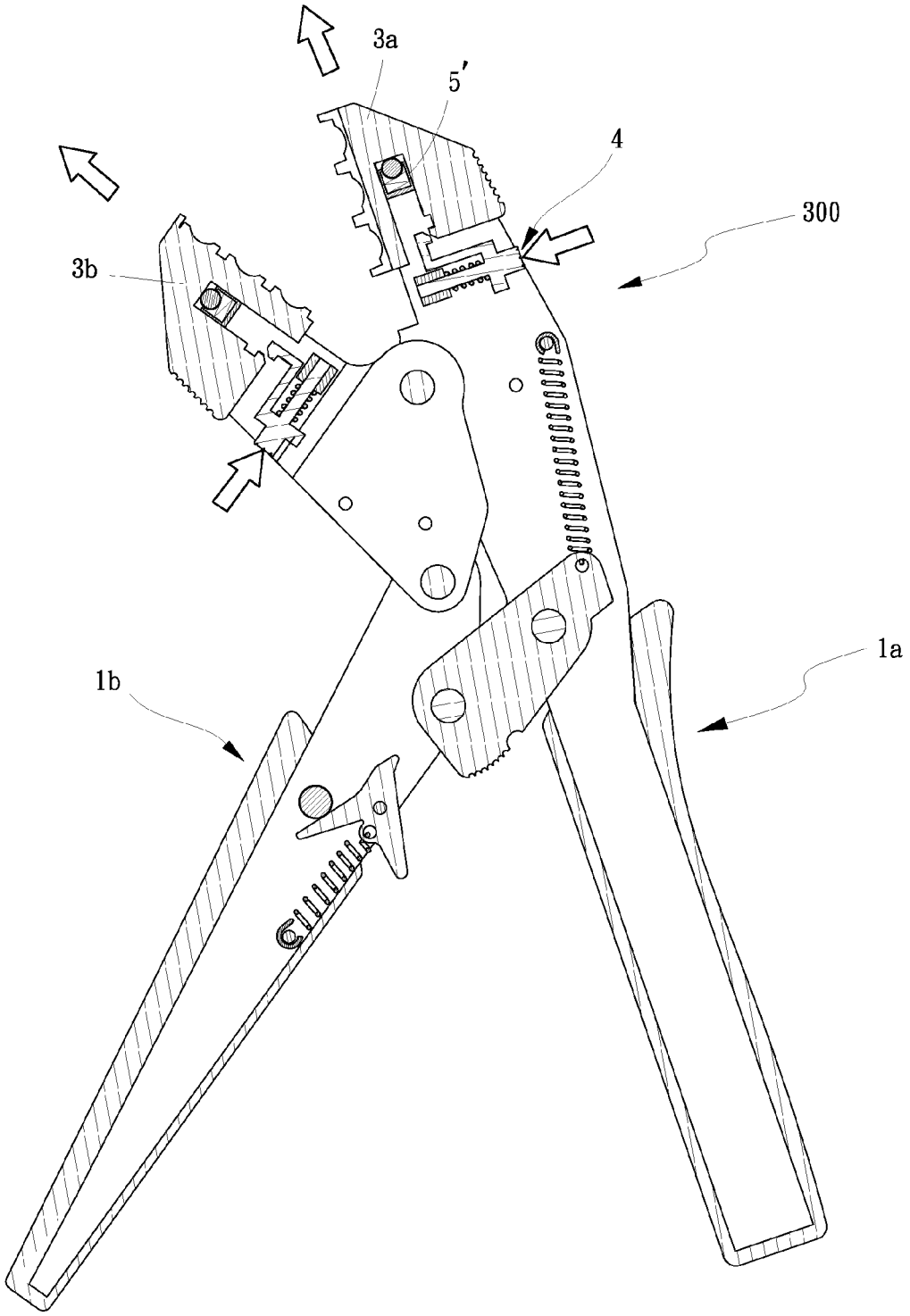
FIG. 16 is a cross-sectional view of pliers in accordance with a third embodiment of the present invention.
Figure 17:
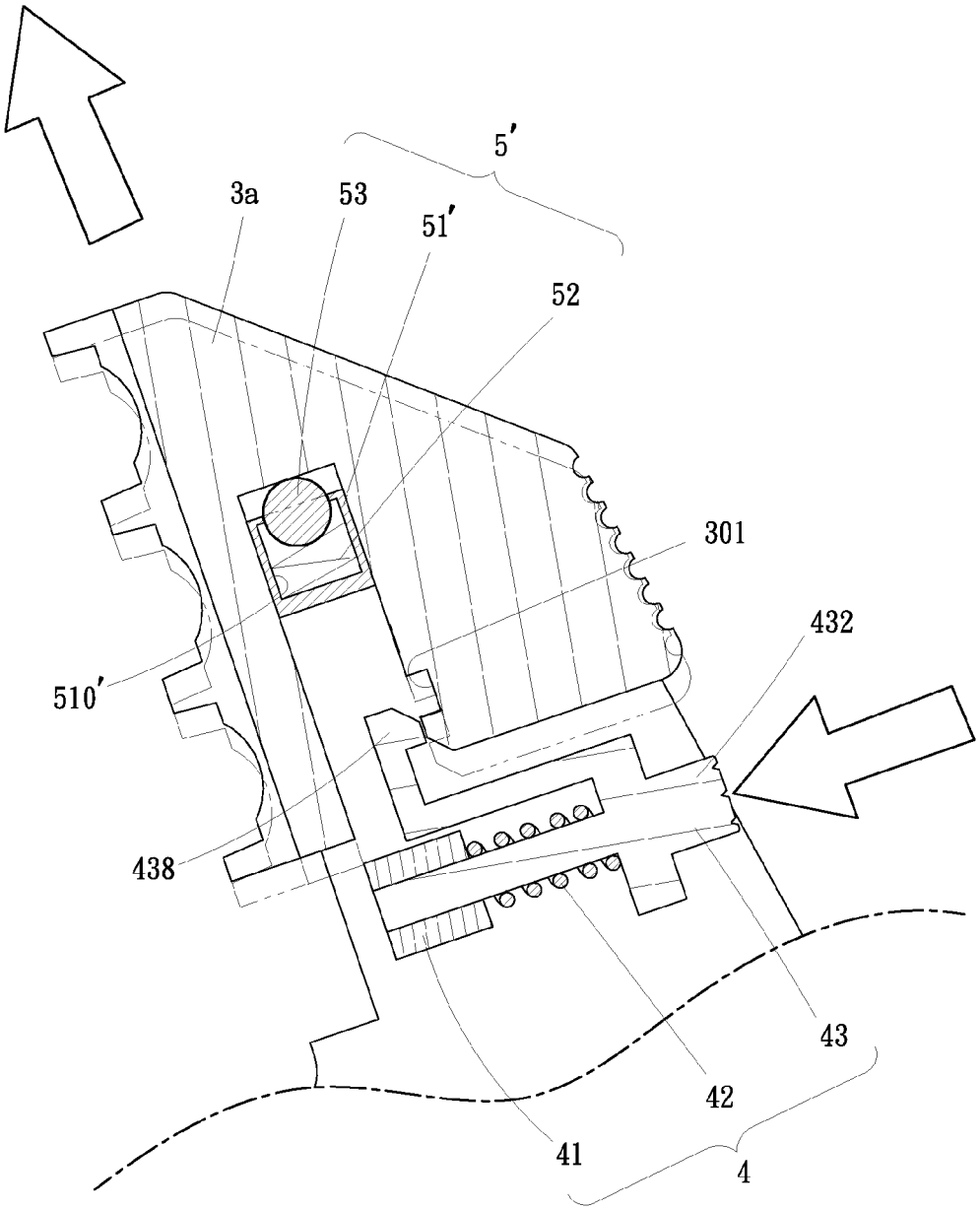
FIG. 17 is a partial enlarged view of the pliers shown in FIG. 16, showing the working jaw (3*a*) is unlocked by pressing the end knob (432) and is bounced out a bit.
Figure 18:
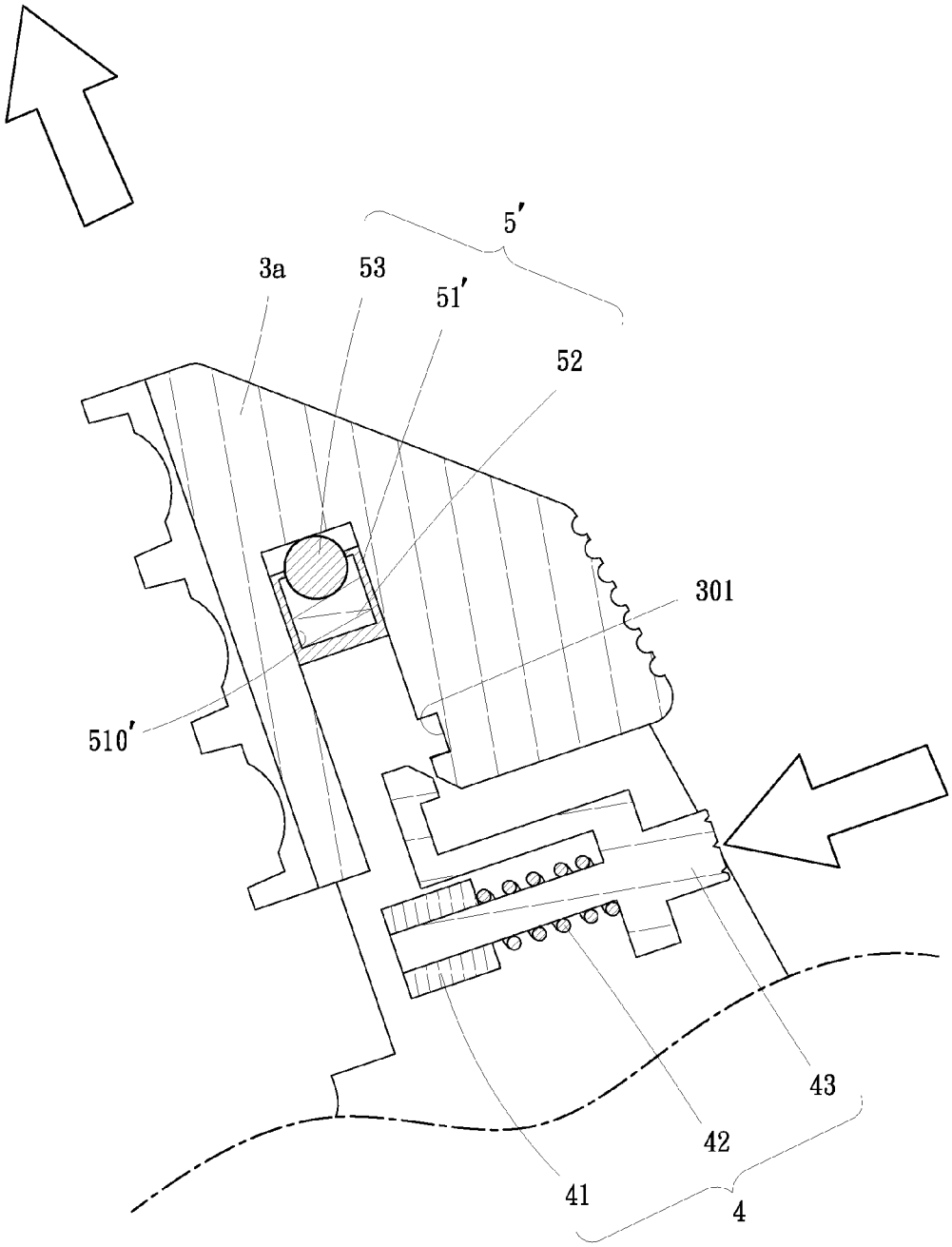
FIG. 18 is a view similar to FIG. 17, showing the working jaw is ready to be removed.

Referring now to FIGS. 16-18, there is shown another alternate embodiment 300. Embodiment 300 is similar to embodiment 100, except that another guiding mechanism 5' is provided in lieu of the aforementioned guiding mechanism 5, and no positioning hole 302 will no longer be needed as in the working jaw 3*a* or 3*b* of the first embodiment 100. As best seen in FIG. 17, the guiding mechanism 5' has a spring-loaded ball detent arrangement that is disposed at a front side of the guiding spacer 51, rather than at the lateral side of the guiding spacer 51 as in the first embodiment 100, to facilitate removal of the working jaw 3*a* from the arm plates 21 of the arm member 2*a*. In this manner, once the driving member 43 is pushed transversely via the end knob 432 to release the working jaw 3*a*, as shown in phantom lines, the working jaw 3*a* is then immediately pushed forward a bit by the spring-loaded ball detent arrangement of the guiding mechanism 51'. Subsequently, the user may relatively easily take the working jaw 3*a* or 3*b* out of the arm member 2*a* or 2*b*.

What is claimed is:

1. Pliers comprising:

a pair of arm members, at least one of which comprising two spaced apart, generally planar, parallel arm plates;

a pair of handles connected to each other for movement of the arm members towards and away from each other;

at least one interchangeable working jaw detachably supported in between the arm plates of the arm member; and at least one control mechanism including a retaining spacer positioned in between the arm plates of the arm member, a driving member movably disposed in between the arm plates of the arm member and having an end knob exposed outside the arm member, and a spring biased between the retaining spacer and the driving member, the driving member includes a rod body having the end knob, and an engaging portion extending from a side of the rod body for engagement with the working jaw, and the spring is mounted around the rod body and biased between the retaining spacer and a shoulder of the rod body;

wherein the control mechanism is arranged in a manner that pressing of the end knob of the driving member drives the driving member to displace with respect to the arm member in a direction substantially vertical to the arm member between a locking position where the driving member is engaged with the working jaw for stopping the working jaw from departing from the arm member, and a releasing position where the driving member is disengaged with the working jaw to allow detachment of the working jaw from the arm member.

2. The pliers of claim 1, further comprising another working jaw supported by the other arm member, wherein the working jaws are provided with at least one mating pair of crimping dies.

3. The pliers of claim 1, wherein each of the arm plates of the arm member defines a guiding hole; and the driving member further includes a pair of projecting lugs extending therefrom and being slidably engaged in the respective guiding holes of the arm plates.

4. The pliers of claim 1, wherein the retaining spacer defines a lateral hole to receive an inner end of the rod body of the driving member, opposite to the outer end knob, to allow transverse movement of the rod body within the retaining spacer.

5. The pliers of claim 1, wherein the engaging portion of the driving member is generally L-shaped, with a substantially transverse first section and a second section that extends substantially perpendicular to the first section and has an end hook; the working jaw defines a notch extending in a direction substantially parallel with the arm member to accommodate the second section of the engaging portion of the driving member; and the notch of the working jaw has an inner wall with a locking groove in which the end hook of the second section of the engaging portion is detachably engaged.

6. The pliers of claim 5, wherein the end hook of the second section of the driving member has a beveled edge to be in contact with the working jaw while the working jaw is being fed in between the arm plates of the associated arm member.

7. The pliers of claim 5, wherein the end hook of the second section of the driving member has a rounded side edge.

8. The pliers of claim 5, further comprising a guiding mechanism which includes a guiding spacer arranged a distance from the retaining spacer of the control mechanism and closer to a front end of the arm member, and the guiding spacer and the retaining spacer are arranged in a line corresponding to the notch of the working jaw to facilitate initial alignment of the working jaw with the arm member.

9. The pliers of claim 8, wherein the guiding mechanism further includes a spring-loaded ball detent arrangement disposed at a lateral side of the guiding spacer to temporarily hold the working jaw in place when the working jaw is fitted in between the arm plates of the arm member.

10. The pliers of claim 9, wherein the notch of the working jaw further has a positioning hole defined in the inner wall thereof for positioning of the spring-loaded ball detent arrangement.

11. The pliers of claim 8, wherein the guiding mechanism further includes a spring-loaded ball detent arrangement disposed at a front side of the guiding spacer to facilitate removal of the working jaw from the arm plates of the arm member.

12. The pliers of claim 1, wherein the working jaw has a lateral side that is textured to facilitate gripping of the working jaw.

13. The pliers of claim 1, wherein the end knob of the driving member of the control mechanism has an outer end surface that is textured.

* * * * *